US011719398B1

(12) United States Patent
Shettigar et al.

(10) Patent No.: US 11,719,398 B1
(45) Date of Patent: Aug. 8, 2023

(54) RECESSED DOWNLIGHT

(71) Applicant: SPECTRUM LIGHTING, INC., Fall River, MA (US)

(72) Inventors: Ketan Devdas Shettigar, Atlanta, GA (US); Thomas Anthony Barber, III, North Attleboro, MA (US); James Edward Kuchar, Fall River, MA (US)

(73) Assignee: SPECTRUM LIGHTING, INC., Fall River, MA (US)

( * ) Notice: Subject to any disclaimer, the term of this patent is extended or adjusted under 35 U.S.C. 154(b) by 0 days.

(21) Appl. No.: 17/877,333

(22) Filed: Jul. 29, 2022

(51) Int. Cl.

| | |
|---|---|
| ***F21S 8/02*** | (2006.01) |
| ***F21V 7/00*** | (2006.01) |
| ***F21V 7/04*** | (2006.01) |
| ***F21V 7/10*** | (2006.01) |
| ***F21V 29/70*** | (2015.01) |

(52) U.S. Cl.
CPC ..... *F21S 8/02* (2013.01); *F21V 7/0033* (2013.01); *F21V 7/045* (2013.01); *F21V 7/10* (2013.01); *F21V 29/70* (2015.01)

(58) Field of Classification Search
CPC ..... F21V 29/70
See application file for complete search history.

(56) References Cited

U.S. PATENT DOCUMENTS

| | | | | |
|---|---|---|---|---|
| 3,643,089 | A * | 2/1972 | Marantz | F21S 8/026 362/346 |
| 4,475,147 | A * | 10/1984 | Kristofek | F21V 7/0025 362/361 |
| 5,535,110 | A | 7/1996 | Ling | |
| RE36,908 | E * | 10/2000 | Ling | F21S 8/04 362/348 |
| 6,561,670 | B1 * | 5/2003 | Jongewaard | F21V 13/04 362/147 |
| 6,632,006 | B1 | 10/2003 | Rippel et al. | |
| 7,384,167 | B1 * | 6/2008 | Gamache | F21S 8/02 362/147 |
| 8,770,779 | B2 | 7/2014 | Steadman et al. | |
| 9,052,081 | B1 * | 6/2015 | Paulsel | F21V 17/105 |
| 9,234,640 | B2 | 1/2016 | Geralds et al. | |
| 9,353,922 | B2 * | 5/2016 | Ferrier | F21V 7/0008 |
| 10,006,605 | B2 | 6/2018 | Zhang et al. | |
| 11,098,862 | B2 | 8/2021 | DeVol et al. | |
| 11,428,398 | B1 * | 8/2022 | Portinga | F21V 29/74 |
| 2007/0047236 | A1 * | 3/2007 | Wilson | F21S 8/02 362/341 |

(Continued)

FOREIGN PATENT DOCUMENTS

| | | |
|---|---|---|
| WO | 2017150456 | 9/2017 |

OTHER PUBLICATIONS

"6LBVLW (6LB79VLW) Wall Wash" Caliber Plus Architectural. Pathway Lighting Products, Inc. 2 pages.

*Primary Examiner* — Zheng Song
(74) *Attorney, Agent, or Firm* — Gray Ice Higdon

(57) ABSTRACT

A recessed open aperture wall wash reflector and light is provided. The wall wash reflector of the light includes a top wall supporting a light module and also having a light entry aperture. A spherical or spheroid curved reflector extends downwardly from the top wall opposite a depending reflector wall which work in conjunction to provide even illumination along a wall adjacent the recessed reflector while also minimizing glare from the light source.

15 Claims, 6 Drawing Sheets

(56) References Cited

U.S. PATENT DOCUMENTS

| | | | | |
|---|---|---|---|---|
| 2007/0258233 | A1 | 11/2007 | Gray | |
| 2014/0003039 | A1* | 1/2014 | Steadman | F21S 8/022 362/147 |
| 2014/0313737 | A1* | 10/2014 | Watson | F21V 7/00 362/307 |
| 2015/0241027 | A1* | 8/2015 | Zhang | F21V 7/0033 362/300 |
| 2016/0320022 | A1* | 11/2016 | Chen | F21V 7/0016 |
| 2018/0210135 | A1* | 7/2018 | Randolph | G02B 6/0036 |

* cited by examiner

RECESSED DOWNLIGHT

BACKGROUND

Recessed downlighting utilizes interior reflector and other lighting components. When further redirection is required, such as in indirect lighting or wall wash lighting, normally specialized add-on hardware is utilized to provide specific lighting characteristics needed. For example, sometimes in wall wash applications, the recessed 'can' or light fixture is structurally tilted towards the illuminated vertical surface. Alternatively, for example, insert reflectors are added to 'throw' light at a high output angle from the fixture towards the wall.

SUMMARY

In various embodiments, a recessed open aperture wall wash light is provided which does not include any interior add-on hardware apart from a primary reflector. The reflector is designed to provide even illumination to the wall from top to bottom without requiring the fixture to be angled towards the illuminated surface. Further, providing wall wash effect without directly exposing the bright illumination or light source from below results from the various embodiments disclosed. The downlight reflector shields direct viewing of the light source by placing it further away from the illuminated wall and combining it with a forward spherical or spheroid reflector surface, an opposing reflector wall and a sloped or angled reflector wall. These surfaces act to non-centrally position the light entry point or aperture of the reflector away from the illuminated wall thus reducing the required redirection/reflected angle for wall washing. In some embodiments, these combined effects result in an even light distribution on the illuminated wall from top to bottom, having a vertical uniformity ratio of about 3:1 and horizontal uniformity ratio of about 1:1.

In embodiments, the downlight reflector includes a top wall which can support the LED or other light emitter, the top wall having a light entry aperture through which the light emitted by the light source/light emitter enters into the reflector. A spherical or spheroid reflector surface is provided opposite a depending reflector wall so that they can work in conjunction to allow the light to be projected towards the wall uniformly. In other words, the forwardly positioned, away from the illuminated wall, spherical or spheroid reflector surface acts as an indirect surface to redirect light either directly from the light source or from light reflected from the opposing depending reflector wall.

Positioning of the light entry aperture towards the spherical or spheroid reflector surface allows such surface to work in combination with the depending reflector wall for minimal light loss and glare reduction, particularly from the perspective of a viewer facing the wall, by projecting most of the light emitted onto a wall having a zero degree angle and contributing minimal light projection at a ninety degree angle. Further, the angled reflector wall which extends rearwardly from the bottom edge of the depending reflector wall further reduces loss of light by utilizing the small amount of widely reflected light away from the illuminated wall, further contributing to the reduction of glare.

Therefore, consistent with one aspect of the invention, a recessed open aperture wall wash light may comprise a light source connectable to a power supply and a recessed housing surrounding at least a part of a downlight reflector and a heat sink in thermal communication with the light source and extending away from the light source to dissipate heat generated by the light source. The downlight reflector may include a light exit aperture and a light entry aperture, where the light entry aperture opposes the light exit aperture, a top wall of the reflector having the light entry aperture, a spherical or spheroid reflector surface between the top wall of the reflector and the light exit aperture where the light entry aperture is non-centrally positioned relative to and opposing the light exit aperture and towards a forward wall of the spherical or spheroid reflector surface, the forward wall of the spherical or spheroid reflector surface opposing a depending reflector wall, and an angled reflector wall extending away from the depending reflector wall at a lower end of the depending reflector wall and towards a rear edge of the light exit aperture. The downlight reflector may be split into a first half and a second half formed along a plane extending between the rear edge of the light exit aperture and the forward wall of the spherical or spheroid reflector surface.

In some embodiments, the depending reflector wall has a height which is less than half the height of the downlight reflector determined between the top wall and the open exit aperture.

In some embodiments, the first half and the second half are joined along a vertical connecting flange on the forward wall and a sloped connecting flange extending from the top wall to the rear edge of the light exit aperture.

In some embodiments, the light source is an LED mounted on a light module.

In some embodiments, the forward wall of the spherical or spheroid reflector surface curves outward away from the depending reflector wall to a center plane and then curves inward towards the light exit aperture.

In some embodiments, the light exit aperture is elliptical. In some embodiments, the light exit aperture is oval.

In some embodiments, the depending reflector wall depends from the top wall of the downlight reflector. In some embodiments, the depending reflector wall depends from the top wall along a plane adjacent the light entry aperture.

In some embodiments, the downlight reflector split into the first half and the second half is formed along the plane extending between the rear edge of the light exit aperture and the forward wall of the spherical or spheroid reflector surface, the plane extending through the light entry aperture.

Consistent with another aspect of the invention, a recessed open aperture wall wash light may comprise an LED source mountable over a light entry aperture of a downlight reflector and a recessed housing surrounding at least a part of the downlight reflector. The downlight reflector may include a light exit aperture opposing the light entry aperture, a top wall of the reflector having the light entry aperture, a spherical or spheroid reflector surface between the top wall of the reflector and the light exit aperture where the light entry aperture is non-centrally positioned relative to and opposing the light exit aperture, and an angled reflector wall extending away from the depending reflector wall at a lower end of the depending reflector wall and towards a rear edge of the light exit aperture. The downlight reflector may be split into a first half and a second half.

In some embodiments, the light entry aperture non-centrally positioned relative to and opposing the light exit aperture is positioned towards a forward wall of the spherical or spheroid reflector surface, where the forward wall of the spherical or spheroid reflector surface opposes a depending reflector wall.

In some embodiments, the downlight reflector split into a first half and a second half is split along a plane extending between the rear edge of the light exit aperture and the forward wall of the spherical or spheroid reflector surface.

In some embodiments, the plane extending between the rear edge of the light exit aperture and the forward wall of the spherical or spheroid reflector surface extends through the light entry aperture.

In some embodiments, the first half and the second half are joined along a vertical connecting flange on the forward wall and a sloped connecting flange extending from the top wall to the rear edge of the light exit aperture.

Other aspects described herein include a recessed open aperture wall wash light having a light module mounted over a light entry aperture of a downlight reflector and a recessed housing surrounding at least a part of the downlight reflector. In some embodiments the downlight reflector includes a light exit aperture opposing the light entry aperture, where a top wall of the reflector has formed therein the light entry aperture. A spherical or spheroid reflector surface is provided between the top wall of the reflector and the light exit aperture and which opposes a depending reflector wall which extends downward from the top wall to reflect light from both the light source and also from the opposing reflector spherical or spheroid surface. The depending reflector wall extends from the top wall at least partially along a predetermined depth or length between the top wall and the light exit aperture. For example, it could have a length of one half the total reflector depth. The light entry aperture is further non-centrally positioned relative to and opposing the light exit aperture to utilize better the cooperative reflecting surfaces of the reflector. There is further an angled reflector wall depending away from a lower edge of the depending reflector wall at a lower end of the depending reflector wall which extends towards a rear edge of the light exit aperture.

In still further aspects, the depending reflector wall is substantially perpendicular to the top wall or may, in alternative implementations, be angled away from or towards the forwardly positioned spherical or spheroid reflector surface.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" or "illumination source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. A given unit may have any one of a variety of mounting arrangements for the light source(s), enclosure/housing arrangements and shapes, and/or electrical and mechanical connection configurations. Additionally, a given unit optionally may be associated with (e.g., include, be coupled to and/or packaged together with) various other components (e.g., control circuitry) relating to the operation of the light source(s). An "LED-based fixture" refers to a lighting unit that includes one or more LED-based light sources as discussed above, alone or in combination with other non-LED-based light sources. A "multi-channel" lighting unit refers to an LED-based and/or non-LED-based lighting unit that includes at least two light sources configured to respectively generate different spectrums of radiation, wherein each different source spectrum may be referred to as a "channel" of the multi-channel lighting unit.

The term "round" is used herein to refer to an implementation, orientation, and/or geometric configuration of one or more objects, structures, and/or apertures. As used herein, "round" may refer to a circular configuration in which all points of a plane are an equally fixed distance from a fixed center, as applied in one or more dimensions. As used herein, "round" may refer to configurations of one or more straight lines and one or more angles between said one or more straight lines, such as a polygon, as applied in one or more dimensions, excluding configurations which are quadrilateral having four right angles. As used herein, "round" may refer to an oval or elliptical configuration having one or more vertices and no straight lines, as applied in one or more dimensions.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

DETAILED DESCRIPTION

Figure 1:
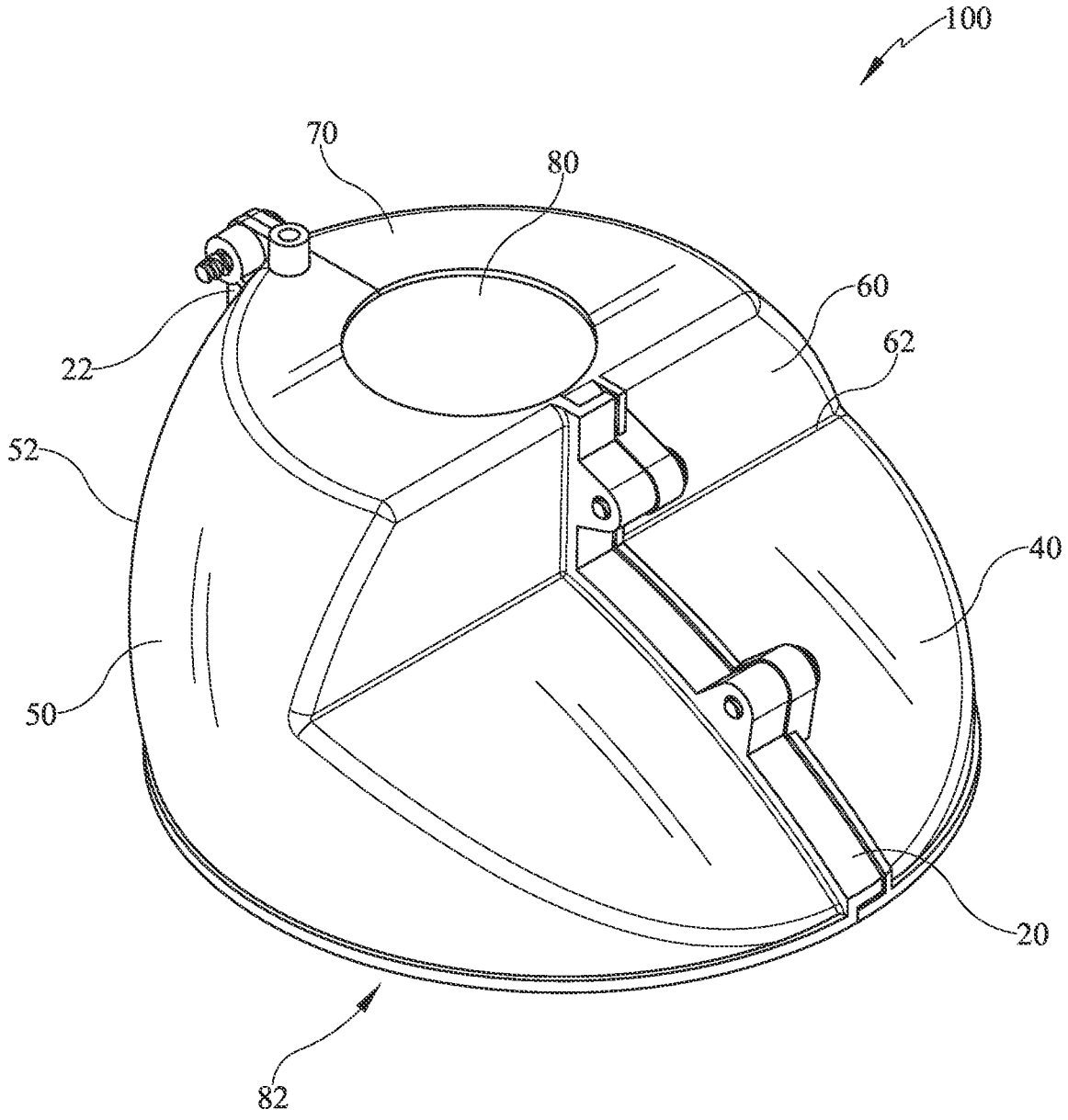
FIG. 1 depicts an example of a recessed open aperture wall wash reflector described herein.

It is to be understood that a light fixture is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Turning to FIGS. 1-5, implementations of the recessed open aperture wall wash reflector downlight are shown. FIG. 1 depicts an example of the wall wash reflector 100 for use in the recessed fixture housing 110 shown in FIGS. 4 and 5. The entire fixture, as depicted, incorporates features to implement a recessed fixture above the ceiling line.

Figure 4:
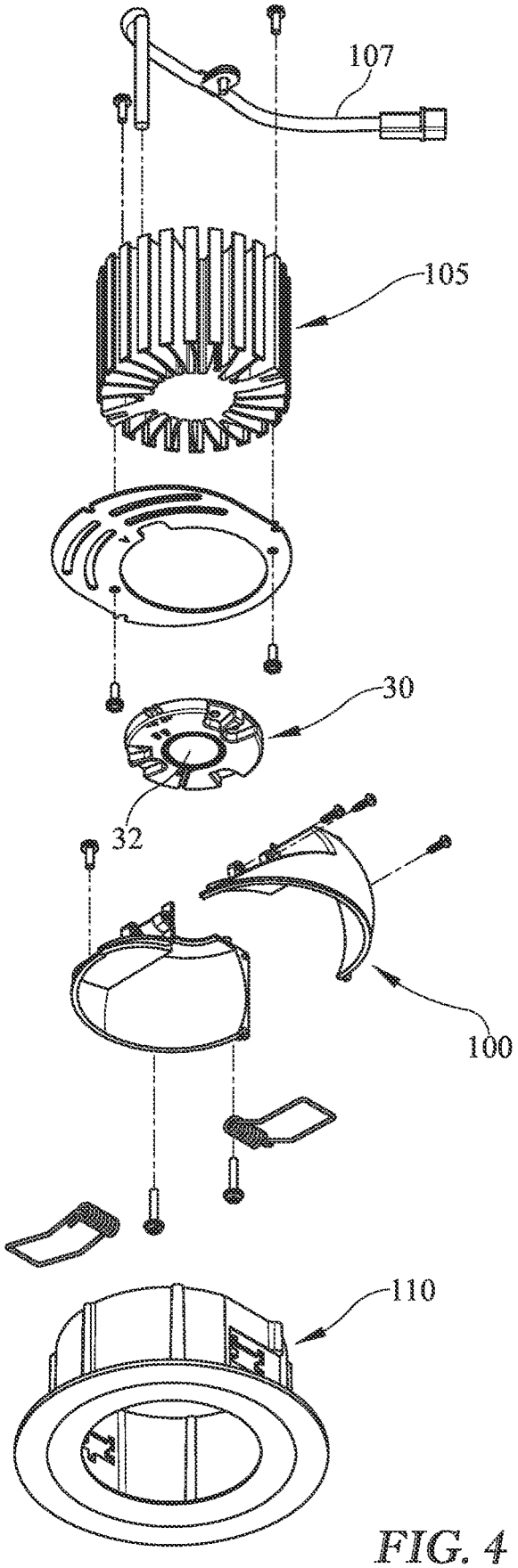
FIG. 4 depicts an exploded view of various elements of a recessed wall wash fixture utilizing the reflector of FIG. 1.
Figure 5:
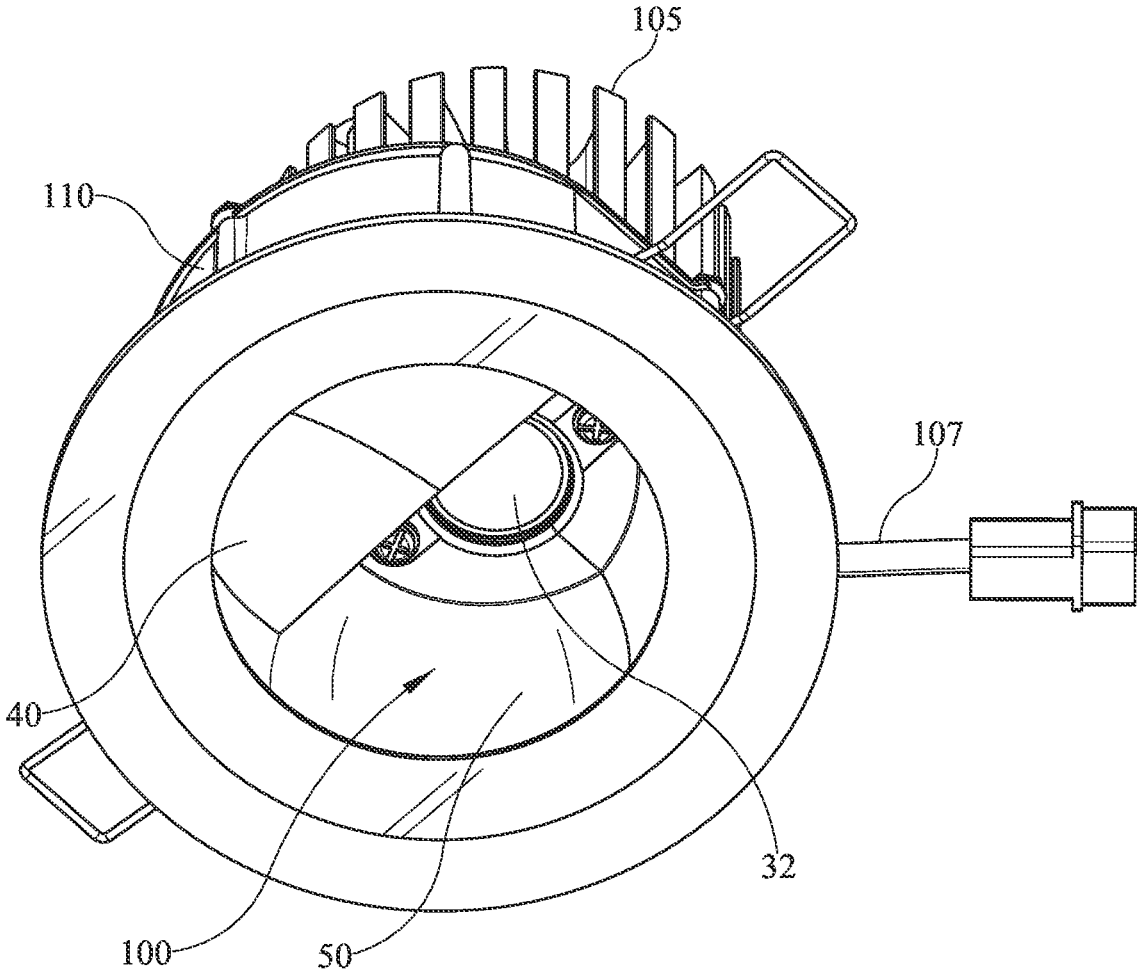
FIG. 5 is a lower perspective view of the assembled recessed wall wash fixture of FIG. 4.

As depicted in FIGS. 4 and 5, the downlight reflector 100 is combined within a recessed fixture housing 110 allowing for wall wash illumination from a light module 30 including a light source 32, such as for example an LED light source. The light module 30 may be installed along a top surface of the wall wash reflector 100 such that light emitted from the LED 32 enters the reflector 100 and is redirected for purposes and in manners as outlined herein.

Positioned atop the light module 30 and in thermal connectivity therewith may be a heat sink 105 to dissipate heat away from the light module 30. The heat sink 105 can include a separated structure from the recessed fixture or can be integrated within the entirety of the fixture to dissipate heat generated by the LED 32. For example, a heat sink 105 may extend upward into a substantially open space above the recessed fixture to allow for adequate heat dissipation. In other examples, the heat sink may be integrated around the light fixture or be entirely separated therefrom, so long as heat is thermally conducted away from the light module 30.

Connecting the light module to a power source may be accomplished by a power cord 107 which may be integrated with the light module or which may include a separate pluggable cord which extends to a remotely positioned junction box. The power cord could provide modified or unmodified electricity to the light module. For example, electrical modification of the line voltage may occur within the junction box or may occur onboard the light module 30. Similarly, a separate structure may be interposed between the power source, junction box and light module to similarly modify the output electrical characteristics as may be necessary for driving the LED of the LED light module.

In some examples, on board electronics may modify the high voltage to low voltage rectified power. In other examples, LED drivers can be positioned remotely from the light module 30.

Figure 2:
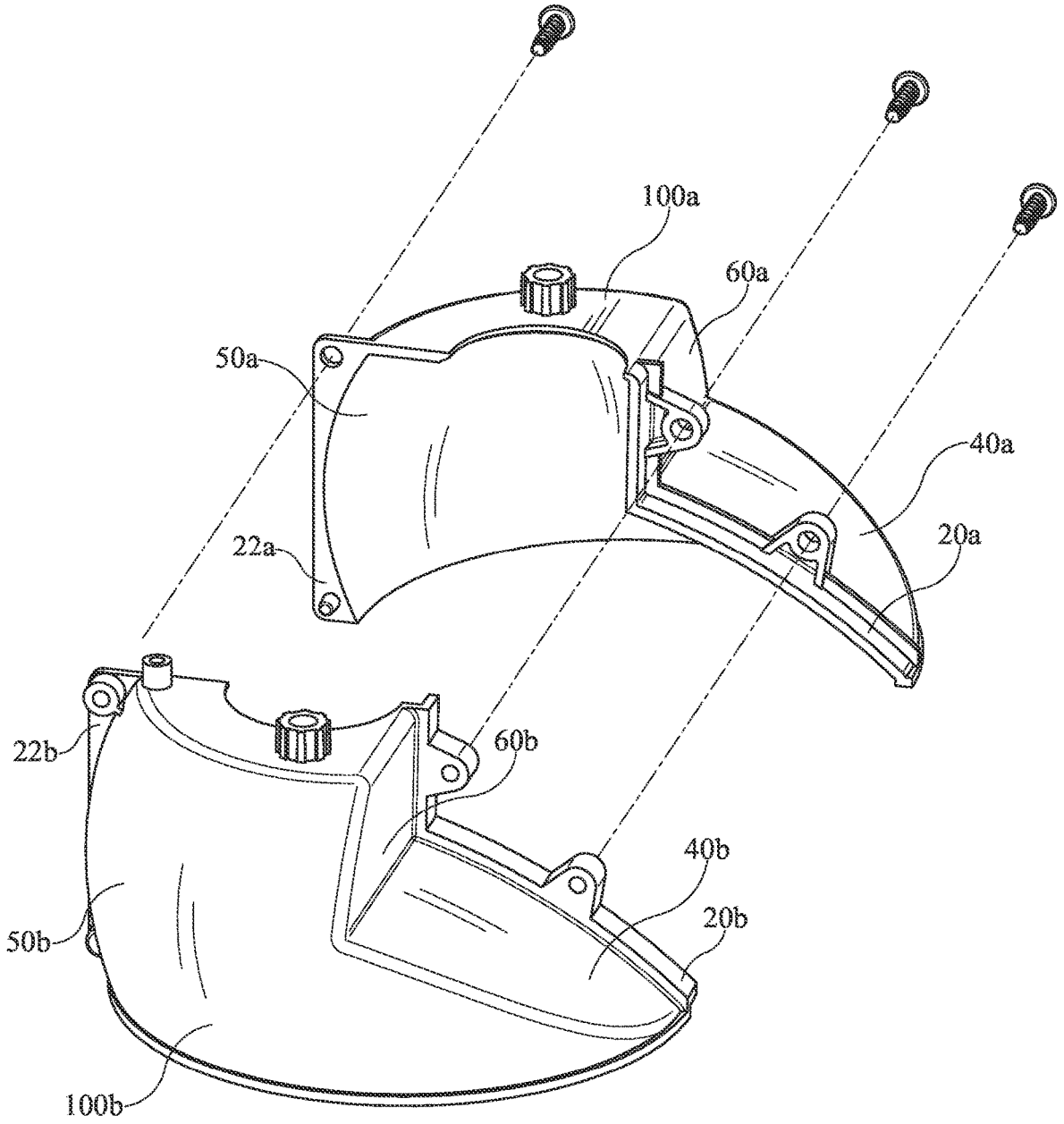
FIG. 2 depicts an exploded view of the reflector shown in FIG. 1.
Figure 3:
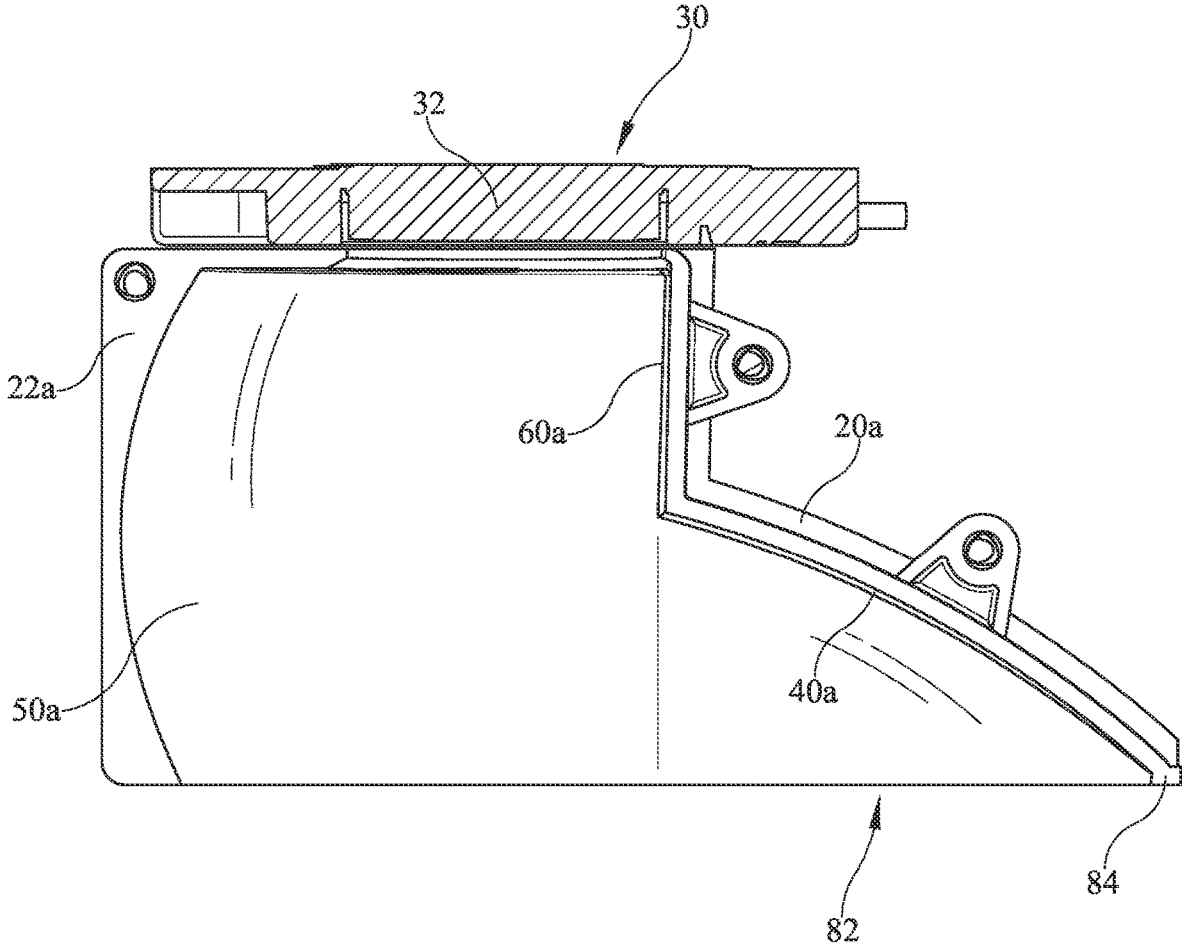
FIG. 3 depicts a side sectional view of the reflector and light source combination described herein.

Turning to FIGS. 1-3, an example of the wall wash reflector 100 is depicted wherein the reflector includes a light entry aperture 80 over which the light module 32 may be placed. The LED 30 of the light module 30 may thereby emit light into the interior of the wall wash reflector 100 allowing for redirection of the emitted light for wall wash characteristics. In other embodiments, a non-LED light source may be utilized. For example, high intensity light sources such as tungsten-halogen lamps and arc-lamps may be utilized.

In some implementations, the top wall 70 may be removed entirely and not be included and the substrate for the LED may provide the top wall plane wherein the depending reflector wall 60 and the spherical or spheroid reflector surface 50 (50*a*/50*b*) extend downward from the plane defined by the support structure or substrate for the light emitting structure. For example, an LED substrate material may extend over an entire opening along the top of the reflector 100 and support an LED or other light emitting structure while no definite top wall structure to the reflector is directly below the substrate. However, in such a construction, the top wall is formed along the plane defined by the substrate and encompassed therein.

The exemplary wall wash reflector depicted in some embodiment includes the light entry aperture which is positioned in opposing relationship with the light exit aperture 82. Interposed between the light entry aperture 80 and the light exit aperture 82 are the various reflective surface to achieve the wall washing effect. In some embodiments, adequate wall washing effect is produced using an even light distribution along the vertical surface of the adjacent wall substantially from top to bottom, producing, for example, a vertical uniformity ratio of 3:1 or lower and a horizontal uniformity ratio of 1:1. However, as appreciated by one having ordinary skill in the art, other variations of the vertical uniformity ratio and the horizontal uniformity ratio may be used as well. The multiple designs and examples depicted herein provide such uniformity and also produce little light scattering effect into the interior of the room, away from the illuminated wall.

In various implementations, the wall wash reflector 100 may include a spherical or spheroid reflector surface 50 directly below the emitter of the LED or light source at the light entry aperture. For example, in FIG. 1 the spherical or spheroid reflector surface, the exterior of which is depicted and labeled, extends below the top wall 70 towards the light exit aperture 82. The spherical or spheroid reflector surface may be positioned only on a portion of reflector. For example, in some implementations the surface 50 may be formed from a hemisphere defined forward of the plane of the downwardly depending reflector wall 60. In other examples, the spherical or spheroid reflector surface may form a part of the forward part of the reflector 100 or be less than this hemisphere. For examples, the spherical or spheroid reflector surface 50 is positioned to collect light directly from the light source in combination with reflected light from the downwardly depending wall 60, to illuminate the wall and also below the position of the recessed fixture.

In still further examples, the spherical or spheroid reflector surface extends towards the illumined wall and towards the rear edge 84 of the light exit aperture 82. For example, in one embodiment the reflector 100 extends towards such rear edge but is not receiving reflected light from either the wall 60 or the light source 32. In examples, the spherical or spheroid reflector surface as described merely collects light from the rear depending wall 60 as well as from the light source and failure to include or exclude other structural elements does not change the scope of the features specified herein.

Figure 6:
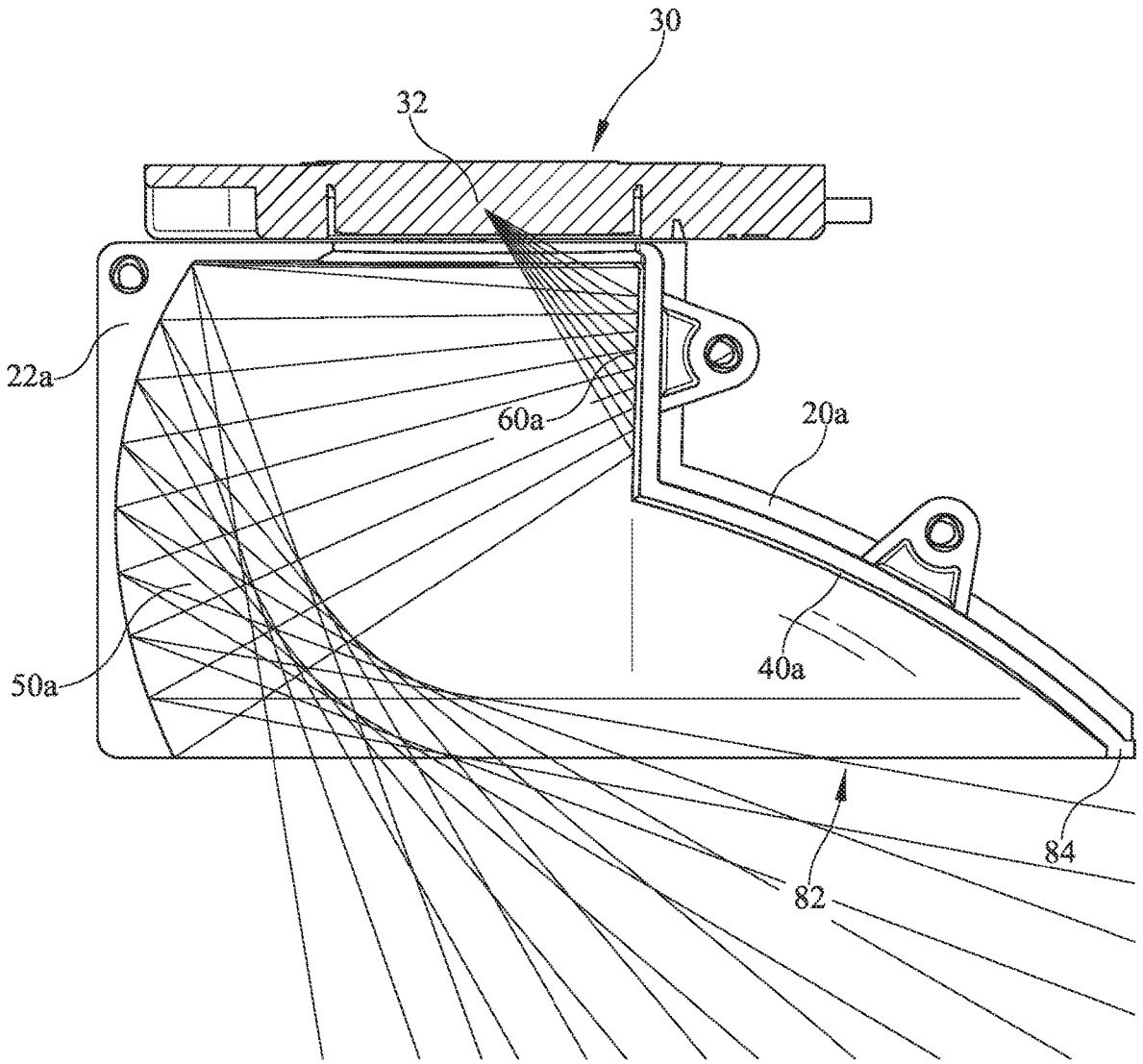
FIG. 6 depicts an exemplary ray trace from a single point light source using the reflector of FIG. 1.

The spherical or spheroid reflector surface 50 extends downward and curves slightly outward, away from the direction of the illuminated wall. The spherical or spheroid reflector surface 50 may optionally include a forward wall 52 of the curved reflector. Forward wall 52 may be a portion of the surface 50 which is opposite the rear edge 84 of the light exit aperture and approximately defines a width of the reflector 100. The spherical or spheroid reflector surface 50 provides an even light distribution out of the light exit aperture 82 wherein, as shown in FIG. 6, light reflected along an upper portion of the spherical or spheroid reflector, nearer to the top wall 70, provides more downlight and less wall wash reflected light. As the spherical or spheroid reflector surface 50 extends further away from the top wall 70 towards the exit aperture 82, the light is reflected at more of a severe angle exiting the exit aperture 82.

For example, as shown in the FIG. 6 optical trace, light which is reflected from an upper surface of the opposing depending reflector wall 60 (60*a*/60*b*) will be reflected from the spherical or spheroid reflector surface 50 in a more downlight direction. Alternatively, light reflected from a lower end 62 of the depending reflector wall 60 will be more severely reflected towards the rear edge 84 of the light exit aperture and hence the upper portion of the illuminate wall.

The light trace diagram of FIG. 6 is for exemplary purposes only for explanation of the impacts of reflected light of the depending reflector wall 60. Other light from the light source or LED 32 will be emitted and reflected by the spherical or spheroid reflector surface 50.

The examples of the reflector in FIGS. 1-6 are depicted variously with a first reflector half 50*a* and second reflector half 50*b* for the combined wall wash reflector. Throughout the figures the elements for either of the first half 50*a* or second half 50*b* are referenced with similar reference indicators. However, other examples may variously include a unitary structure without bifurcation of the reflector as shown. The reference numbers provided between the first half 50*a* and second half 50*b* of the reflector are simply depicted for ease of explanation and no limitations are to be construed therefrom. Similarly, while the figures depict in many instances a portion of the reflector for either the first or the second half of the wall wash reflector, and include referencing indicia for such half, such features are to be interpreted singularly for the entirety of the wall wash reflector system. For example, the reflector spherical or spheroid reflector 50 is depicted variously in the figures as 50*a* and 50*b* referencing the exemplary half structure. Such half structures however are not needed and the entirety of the spherical or spheroid reflector is being described in such depiction and explanation.

Returning to the figures, the top wall 70 supports the light module 30 suspending the LED 32 over the light entry aperture 80. Light entry aperture as shown in this example is positioned off center relative to the opposing light exit aperture 82 and towards the forward wall 52 of the spherical or spheroid reflector surface 50. This portion of the reflector, the forward wall 52, is the position furthest away from the wall being illuminated and in opposing relationship to the rear edge 84 of the light exit aperture. The light entry aperture 80 allows the LED or other light source to emit light into the reflective interior of the reflector while the top wall 70 allows a mounting surface for the light module. While the top wall allows for positional mounting of the light module 30, actual physical mounting is not required as the module 30 may be suspected in position over the aperture 80.

Opposite the spherical or spheroid curved reflector surface 50 and adjacent the light entry aperture 80 is the depending reflector wall 60 which is provided to reflect light, as shown in FIG. 6, from the LED to the various positions of the spherical or spheroid curved reflector surface 50. Depending reflector wall 60 extends to a lower end 62 where the upper surface of the reflector 100 (100*a*/100*b*) transitions to an angled reflector wall 40. The angled reflector wall 40 results in collection of stray light downward while also reducing glare from the emitter when viewed facing the illuminated wall. The angled reflector wall 40 may be slightly curved in order to slightly concentrate light towards a focal point, or may be flat.

In some examples, the wall wash reflector may include a first half 50*a* and a second half 50*b*. In some implementations, providing first and second halves may aid in manufacturing and assembly. As depicted, the halves may be joined along a vertical connecting flange 22 (22*a*/22*b*) and a sloped connecting flange 20 (20*a*/20*b*). The flanges 20, 22 may be provided to allow for a mechanical interfacing surface for screws or other mechanical connection devices. For examples, mated threaded apertures may be included to receive screws or the like. Similarly one way snap fit connection hardware may also be provided to combine the halves.

The vertical connecting flange as depicted in the examples extends along the outer surface of the spherical or spheroid reflector surface. Similarly, the sloped connector flange 20 extends along the outer surface of the angled reflector wall 40 (40*a*/40*b*). However, many different positions may be provided for mechanical interface and mating and no unnecessary limitations should be construed from such depiction. Likewise, a unitary reflector 100 may be provided without requiring separation into first and second halves and is fully part of the disclosure herein. Further, other separation positions of the reflector apart from bisecting as disclosed to create the first half and second half of the figures may be accomplished. For example, the location of the plane formed between the two halves may be rotated by 90 degrees or more or may be moved to create an upper and lower half. Similarly, various elements may be combined into a single structure such as unitary elements forming the top wall, depending reflector wall, spherical or spheroid reflector and angled reflector wall. These single structure may then be combined into a single reflector structure as depicted.

Light module 30 and LED 32 are one example of a light source provided for wall washing illumination. Exemplary single point light emitters are preferential due to their brightness and control characteristics but not necessarily required. In some implementations, a high output single LED 32 may be provided with incorporated lens structures to diffuse some light emitted from the light module. Similarly, multiple LEDs may be provided on the surface of the light module and similarly utilized to illuminate the wall. Light module 30 may incorporate full control circuitry for driving and LED control onboard. In alternative constructions and embodiments, separated LED drivers and controllers may be placed nearer to a power source, to dissipate heat away from the actual emitter source.

In some implementations, the reflector may be made of a polymeric material in the depicted 2-piece construction. The finish for the various surfaces of the wall wash reflector 100 may be vacuum metalized with a diffused finish thereby resulting in a diffuse reflectance and high reflective characteristics. Further, various diameter and sizes of the reflector may be utilized with the same structural features outlined herein.

As well, in some implementations as is depicted in FIG. 4, multiple components may be utilized for the recessed fixture. Such depiction is provided merely for explanatory purposes as recessed wall wash construction may incorporate many alternative features while still providing the same performance as described. For example, in some implementations, little or no heat dissipation may be required thereby removing the need for a heat sink. As well, the recessed housing 110 and reflector 100 may be combined into unitary structure. For example, a unitary housing structure having internal reflective characteristics outlined herein may be implemented wherein the curved reflector surface, depending reflector wall and angled reflector wall are integrated into a housing and still fall within the disclosure hereof.

While several implementations have been described and illustrated herein, a variety of other means and/or structures for performing the function and/or obtaining the results and/or one or more of the advantages described herein may be utilized, and each of such variations and/or modifications is deemed to be within the scope of the implementations described herein. More generally, all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific implementations described herein. It is, therefore, to be understood that the foregoing implementations are presented by way of example only and that, within the scope of the appended claims and equivalents thereto, implementations may be practiced otherwise than as specifically described and claimed. Implementations of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The invention claimed is:

1. A recessed open aperture wall wash light, comprising:
- a light source connectable to a power supply;
- a recessed housing surrounding at least a part of a downlight reflector;
- a heat sink in thermal communication with the light source and extending away from the light source to dissipate heat generated by the light source;
- the downlight reflector including:
  - a light exit aperture and a light entry aperture, the light entry aperture opposing the light exit aperture;
  - a top wall of the downlight reflector having the light entry aperture;
  - a spherical or spheroid reflector surface extending between the top wall of the reflector and the light exit aperture;
  - wherein the light entry aperture is non-centrally positioned relative to and opposing the light exit aperture and towards a forward wall of the spherical or spheroid reflector surface, the forward wall of the spherical or spheroid reflector surface opposing a depending reflector wall;
  - an angled reflector wall extending away from the depending reflector wall at a lower end of the depending reflector wall and towards a rear edge of the light exit aperture;
  - the downlight reflector split into a first half and a second half formed along a plane extending between the rear edge of the light exit aperture and the forward wall of the spherical or spheroid reflector surface;
  - wherein the first half and the second half are joined along a vertical connecting flange on the forward wall and a sloped connecting flange extending from the top wall to the rear edge of the light exit aperture.

2. The recessed open aperture wall wash light of claim 1 wherein the depending reflector wall depends from the top wall of the downlight reflector.

3. The recessed open aperture wall wash light of claim 2 wherein the depending reflector wall depends from the top wall along a plane adjacent the light entry aperture.

4. The recessed open aperture wall wash light of claim 1 wherein the depending reflector wall has a height which is less than half the height of the downlight reflector determined between the top wall and the light exit aperture.

5. The recessed open aperture wall wash light of claim 1 wherein the light source is an LED mounted on a light module.

6. The recessed open aperture wall wash light of claim 1 wherein the forward wall of the spherical or spheroid reflector surface curves outward away from the depending reflector wall to a center plane and then curves inward towards the light exit aperture.

7. The recessed open aperture wall wash light of claim 1 wherein the light exit aperture is elliptical.

8. The recessed open aperture wall wash light of claim 1 wherein the light exit aperture is oval.

9. The recessed open aperture wall wash light of claim 1 wherein the downlight reflector split into the first half and the second half is formed along the plane extending between the rear edge of the light exit aperture and the forward wall of the spherical or spheroid reflector surface, the plane extending through the light entry aperture.

10. A recessed open aperture wall wash light, comprising:
an LED source mountable over a light entry aperture of a downlight reflector;
a recessed housing surrounding at least a part of the downlight reflector;
the downlight reflector including:
a light exit aperture opposing the light entry aperture;
a top wall of the reflector having the light entry aperture;
a spherical or spheroid reflector surface between the top wall of the reflector and the light exit aperture;
a depending reflector wall extending downward away from the top wall and opposing the spherical or spheroid reflector surface;
wherein the light entry aperture is non-centrally positioned relative to and opposing the light exit aperture;
an angled reflector wall extending away from the depending reflector wall at a lower end of the depending reflector wall and towards a rear edge of the light exit aperture;
the downlight reflector split into a first half and a second half;
wherein the first half and the second half are joined along a vertical connecting flange on the forward wall and a sloped connecting flange extending from the top wall to the rear edge of the light exit aperture.

11. The recessed open aperture wall wash light of claim 10 wherein the light entry aperture non-centrally positioned relative to and opposing the light exit aperture is positioned towards a forward wall of the spherical or spheroid reflector surface, the forward wall of the spherical or spheroid reflector surface opposing a depending reflector wall.

12. The recessed open aperture wall wash light of claim 11 wherein the downlight reflector split into a first half and a second half is split along a plane extending between the rear edge of the light exit aperture and the forward wall of the spherical or spheroid reflector surface.

13. The recessed open aperture wall wash light of claim 12 wherein the plane extending between the rear edge of the light exit aperture and the forward wall of the spherical or spheroid reflector surface extends through the light entry aperture.

14. A recessed open aperture wall wash light, comprising:
a light module mounted over a light entry aperture of a downlight reflector;
a recessed housing surrounding at least a part of the downlight reflector;
the downlight reflector including:
a light exit aperture opposing the light entry aperture;
a top wall of the reflector having the light entry aperture;
a spherical or spheroid reflector surface extending between the top wall of the reflector and the light exit aperture and opposing a depending reflector wall, the depending reflector wall extending downward from the top wall at least partially along a predetermined depth between the top wall and the light exit aperture;
wherein the top wall of the reflector having the light entry aperture opposes the light exit aperture and wherein the spherical or spheroid reflector surface extends between the top wall and the light exit aperture;
further wherein the depending reflector wall opposing the spherical or spheroid reflector surface extends along a predetermined length between the top wall and the light exit aperture of about one half of a reflector depth measured from the top wall to the light exit aperture;
wherein the light entry aperture is non-centrally positioned relative to and opposing the light exit aperture;
an angled reflector wall depending away from the top wall, the angled reflector wall at a lower end of the depending reflector wall and towards a rear edge of the light exit aperture.

15. The recessed open aperture wall wash light of claim 14 wherein the depending reflector wall is substantially perpendicular to the top wall.

* * * * *